US005349845A

United States Patent [19]

Blom

[11] Patent Number: 5,349,845

[45] Date of Patent: Sep. 27, 1994

[54] APPARATUS FOR MEASURING THE CONDITION OF A FELT IN A PAPER MACHINE

[75] Inventor: Mikko Blom, Tampere, Finland

[73] Assignee: Tamfelt Oy Ab, Tampere, Finland

[21] Appl. No.: 41,063

[22] Filed: Mar. 31, 1993

[30] Foreign Application Priority Data

Apr. 7, 1992 [FI] Finland ..... 921532

[51] Int. Cl.[5] ..... G01N 15/08

[52] U.S. Cl. ..... 73/38; 162/263; 34/550; 324/643; 324/644; 374/135; 374/137

[58] Field of Search ..... 73/37.7, 37.8, 38, 866, 73/73; 34/30, 48, 31; 162/263; 324/642, 643, 644; 374/135, 137, 143

[56] References Cited

U.S. PATENT DOCUMENTS

| | | | |
|---|---|---|---|
| 2,197,823 | 4/1940 | Young | 374/137 |
| 3,056,281 | 10/1962 | Smyth | 73/38 |
| 3,619,359 | 11/1971 | Keyes, IV et al. | 162/263 |
| 3,762,211 | 10/1973 | Poulsen | 73/38 |
| 3,801,426 | 4/1974 | Putman et al. | 162/263 |
| 3,859,163 | 1/1975 | Haythornthwaite | 162/198 |
| 4,756,183 | 7/1988 | Rajala et al. | 73/38 |
| 4,892,621 | 1/1990 | Eskelinen | 73/38 |
| 5,022,966 | 6/1991 | Hu | 162/263 |
| 5,135,615 | 8/1992 | Rökman | 162/263 |
| 5,240,564 | 8/1993 | Niskanen et al. | 162/263 |

FOREIGN PATENT DOCUMENTS

| | | |
|---|---|---|
| 1143982 | 4/1983 | Canada . |
| 0243427 | 10/1986 | European Pat. Off. . |
| 903349 | 7/1990 | Finland . |
| 1458294 | 2/1974 | United Kingdom . |

*Primary Examiner*—Hezron E. Williams
*Assistant Examiner*—Michael J. Brock
*Attorney, Agent, or Firm*—Lowe, Price, LeBlanc & Becker

[57] ABSTRACT

The invention relates to a measuring apparatus for measuring the condition of a felt in a paper machine, comprising a measuring head (1) connected to a vacuum source. Air is sucked into the measuring head through the felt, and the air and the water carried with the air are removed through separate conduits. The measuring head comprises a microwave head for measuring the water content of the felt, and a temperature detector for measuring the temperature of the sucked air concurrently with the vacuum measurement.

16 Claims, 2 Drawing Sheets

Figure 3A:
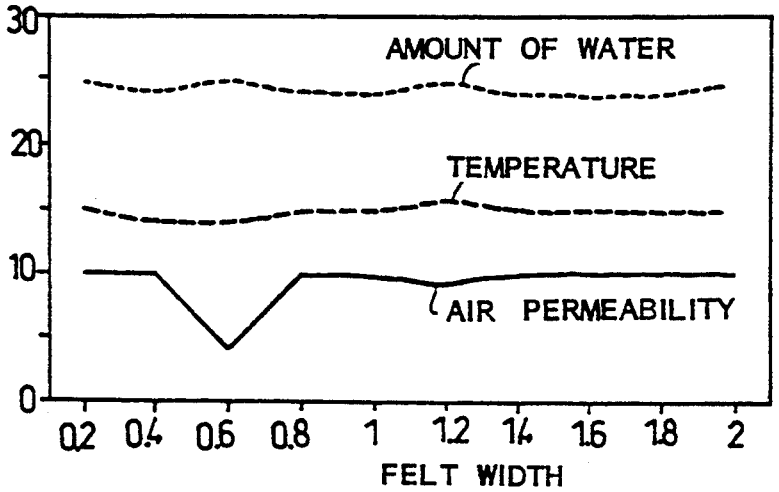

FIG. 1
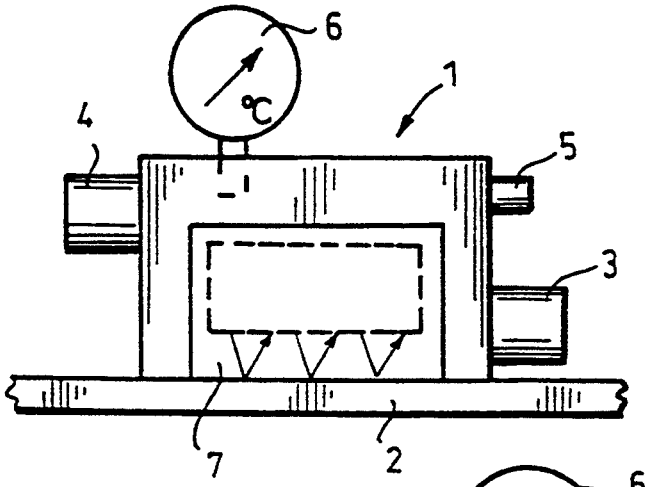
FIG. 2
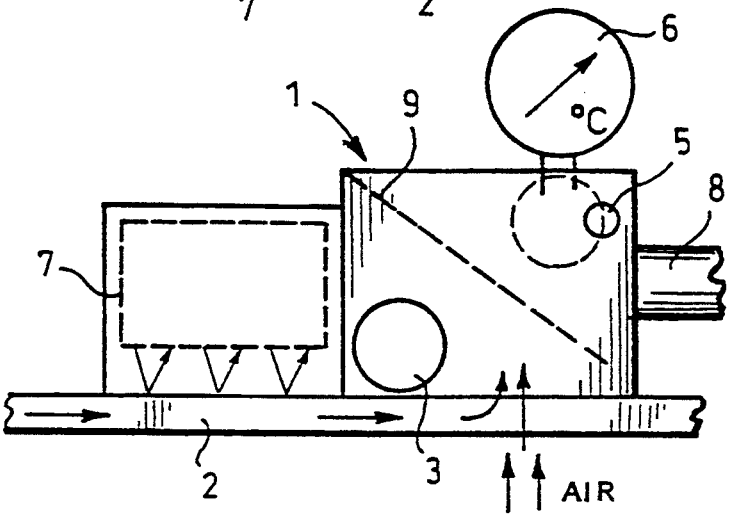
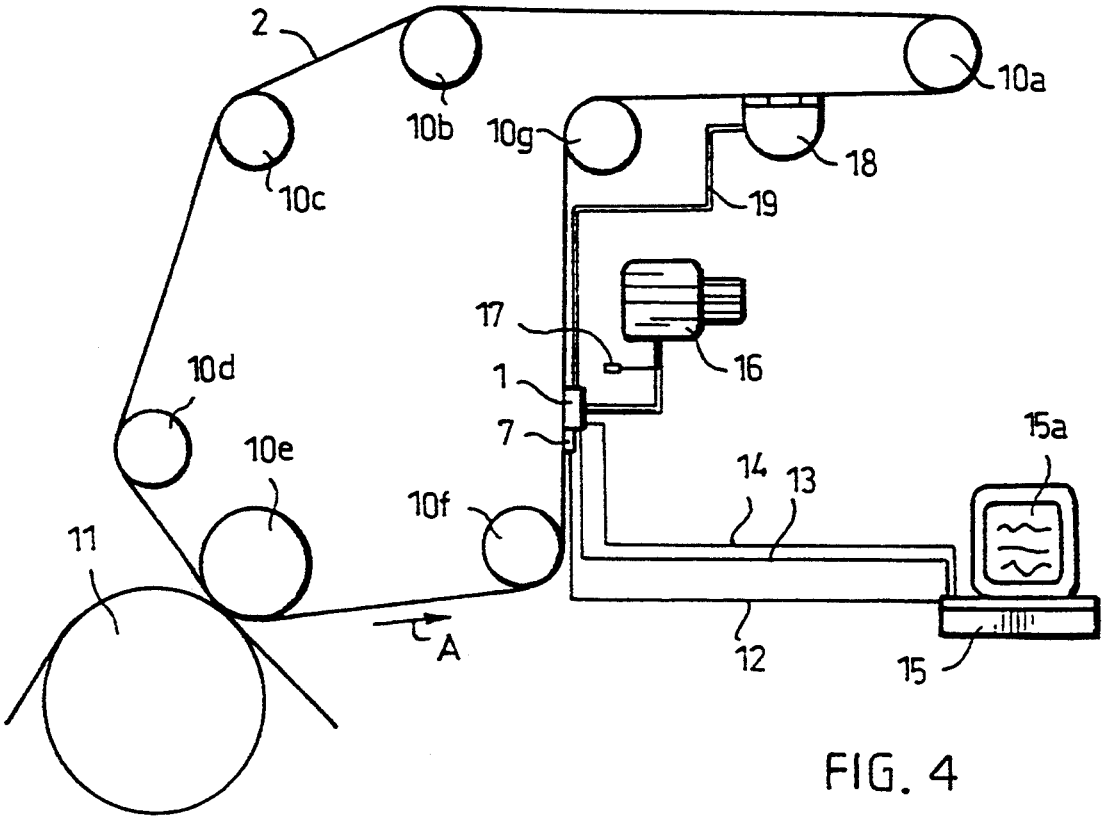
FIG. 4

APPARATUS FOR MEASURING THE CONDITION OF A FELT IN A PAPER MACHINE

The invention relates to an apparatus for measuring the condition of a felt in a paper machine, comprising a measuring head arranged to be positioned against the surface of the felt, an air conduit being connected to the measuring head for sucking air through the felt into the measuring head by utilizing a vacuum, and a water removal conduit being connected to said measuring head for separately removing water carried with the air into the measuring head from the felt; and measuring means for measuring the vacuum created during measuring.

The purpose of press felts in paper machines is to suck water from the fibre web at the different production stages. The condition and performance of such felts are affected by various factors which should be observed and controlled so that the condition of the felts would not cause unnecessary production stoppages or excessive variation or deterioration in quality. In particular, press felts used when squeezing water out of the formed fibre web before drying are important in this respect. The air permeability ($m^3/m^2$ min) is an important functional property of press felts. The air permeability decreases during use as the felt is constantly compressed at a nip. The air permeability of a new press felt is typically about 15 $m^3/m^2$ per minute, whereas the air permeability of a worn-out felt is about 1 to 2 $m^3/m^2$ per minute. The press felt loses its elasticity as a result of the constant compression exerted on it at the nip, in addition to which the air permeability is affected by the clogging of the felt by various particles and fibres carried into the felt by the water removed from the web. This accelerates the deterioration of the felt into a condition unfit for the production process, and therefore the felt has to be cleaned regularly. The compression of the press felt depends on the structure of the press, but the deflection of rolls and other factors typically cause the compression to take place asymmetrically, and so the middle area of the felt usually stretches more than the edge areas. As a result, the water volume and the thickness of the felt are different in the middle and at the edges. Wet wires used in a paper machine are similarly compressed and get clogged, and also require reconditioning. Reconditioning of felts usually takes place by spraying high-pressure water from nozzles e.g. at uniform intervals over the entire area of the felt or at points where the felt is visibly dirty. In general, the cleaning is performed by needle jets positioned at predetermined intervals in the transverse direction of the felt, and the whole row of needle jets is moved to and fro by an oscillating movement over a distance corresponding to the mutual spacing of the needle jets so that they will clean the felt over its entire width. Correspondingly, particles are removed by applying a detergent to the felt and then rinsing it off after a while.

To recondition a felt and to measure its condition, various arrangements have been suggested for measuring the condition i.e. the air permeability of the felt by utilizing a vacuum. Such arrangements are known e.g. from GB Patent 1 458 294, U.S. Pat. No. 3,056,281 and CA Patent 1 143 982. They attempt to determine whether the felt requires reconditioning by various vacuum measurements. However, these arrangements are rather indefinite and fail to provide an accurate measurement of the condition of a felt. The reconditioning of the felt in the cited documents is based on a mere estimation or an average air permeability of the felt, and so the reconditioning cannot be directed appropriately.

FI Patent Application 903349 discloses a measuring and reconditioning apparatus in which the condition of the felt is measured by placing a suction head with a perforated surface against the felt, sucking air through the felt by a vacuum through the perforated surface, separating the water entrained in the air, and measuring the vacuum created. By moving the measuring head suitably across the felt, the permeability profile of the felt in the transverse direction, and, if required, even in the longitudinal direction, can be measured, and so the reconditioning measures can be directed to the most heavily contaminated portions of the felt by a needle jet treatment on the basis of the measured condition. This enables the felt to be reconditioned very accurately, and so the service life of the felt is increased considerably. Increasing operational and quality requirements, however, call for even more efficient measuring and reconditioning techniques to further increase the service life and to be able to perform the reconditioning and other required measures as early as possible. The object of the present invention is to provide a measuring apparatus by means of which different felt properties can be measured in different ways and the reconditioning measures can be anticipated and effected more efficiently than previously. The apparatus according to the invention is characterized in that the measuring apparatus comprises a microwave radiator mounted in the measuring head and connected to the measuring means for measuring the water amount of the felt, and a temperature detector for measuring the temperature of the air sucked through the measuring head into the air conduit.

The basic idea of the invention is that the same measuring apparatus performs both a vacuum measurement and a microwave measurement, and so the reconditioning of the felt can be based on signals obtained from measurements performed in different ways since the vacuum measurement and the microwave measurement indicate different things. Furthermore, in a preferred embodiment of the invention, the measuring head comprises a temperature sensor which measures the temperature of the flow of air produced in the vacuum measurement. All these measurements can thus be performed concurrently or one at a time so as to determine the need of reconditioning in different felt portions or the need of adjustment in the nip.

Figure 3B:
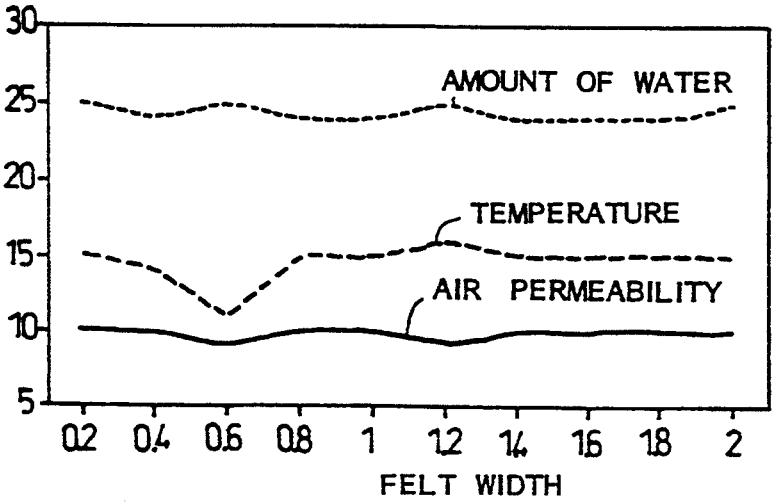
Figure 3C:
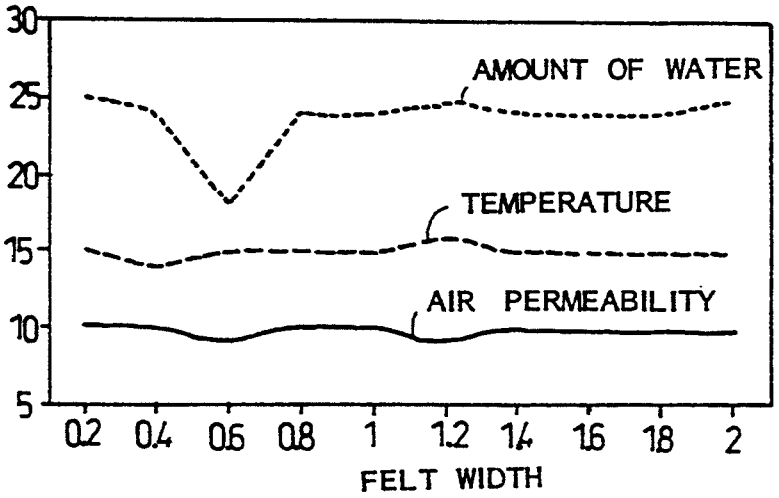

The invention will be described in more detail with reference to the attached drawings, in which FIG. 1 illustrates schematically a measuring head used in the apparatus according to the invention as seen in the direction of travel of the felt;

FIG. 2 illustrates schematically the apparatus of FIG. 1 as seen from the side of the felt;

FIGS. 3*a* to 3*c* are diagrams illustrating the measuring results obtained according to the invention; and FIG. 4 illustrates schematically the apparatus according to the invention in the measuring position.

FIG. 1 shows schematically a measuring head 1 in the measuring apparatus. The measuring head 1 is positioned against a felt 2 for measurement. A water removal conduit 3 is connected to one side of the measuring head 1 for removing water entering the measuring head 1 through the felt 2. An air conduit 4 is connected to the other side of the measuring head for sucking air from the measuring head so that it flows through the felt 2 and carries therewith water, the water being removed through the connection 3. Further, a connection 5 for a vacuum measuring sensor is provided at the side of the measuring head. The sensor measures vacuum in the measuring head in the vacuum measuring position of the apparatus. At the top of the measuring head 1, there is further provided a thermometer 6 or a corresponding temperature sensor which measures the temperature of air discharged therethrough. In addition, a microwave radiator 7 for measuring the moisture and water content of the felt is shown schematically by broken lines in front of the measuring head 1. The microwave radiator 7 emits radiation at a suitable frequency typically of the order of several megahertz or even thousands of megahertz. The radiation is resonant with the liquid content of the felt in a certain manner known per se, thus enabling an accurate measurement of the amount of water contained in the felt. The microwave radiator may also be used for measuring the thickness of the felt so as to determine deviations in the thickness and water amount profiles. As seen from the side of the felt to be reconditioned, the measuring head 1 first comprises a perforated sensor surface. The holes in the surface lead into the measuring head 1, where the air and water sucked from the felt through the holes during the measuring are separated from each other and passed apart. The water is removed from the measuring head 1 through the water removal conduit 3 extending from the lower portion or underside of the measuring head. Correspondingly, mainly air is sucked out of the measuring head through the air suction conduit 4 extending from the upper portion or upper side of the measuring head 1. To facilitate the separation of air from water, the measuring head is provided with a separation plate 9 which extends from the measuring surface downwards and at the same time towards the back portion of the measuring head.

FIG. 2 shows the measuring head as seen from the side of the felt. As appears from the figure, the measuring head 1 is supported by an arm 8 when it is pressed against the felt. FIG. 2 further shows schematically how the inclined partition wall 9 is positioned within the measuring head. The partition wall is provided with holes so that the air sucked through the felt is able to pass therethrough while the water is separated from the air and removed through the connection 3. The supporting means associated with the measuring head and its operation are described by way of example in the above-mentioned FI Patent Application 903349, and its structure is well-known. Accordingly, it will not be described more closely herein. During measuring, the measuring head is pressed against the surface of the felt and displaced in a predetermined manner in the transverse direction of the felt while the felt moves in its normal direction of travel. For instance, by keeping the measuring head at the same position over the entire length of the felt and then displacing it over a suitable sideward distance at a time in the direction of the width of the felt, the transverse profile of the felt, i.e. the different properties of the felt in its direction of width, can be determined while, if required, it is also possible to register the same properties in accordance with the longitudinal direction of the felt so as to determine the present condition and properties of the felt over its entire area. In principle, the measuring head could be kept against the felt 2 continuously, but the condition of the felt need not be measured continuously as the felt requires reconditioning at rather long intervals. To avoid the wear of the measuring head and the felt 2 due to friction therebetween, the measuring head 1 is kept in contact with the felt 2 only during measuring and reconditioning.

When the condition of the felt is measured by means of the apparatus according to the invention, the different ways of measuring allow different things to be measured, and so possible malfunction of the equipment can be detected. In the press section, it can be ascertained by temperature measurements that the drying energy spreads evenly across the web and thus across the felt. In addition, the operation of the steam box, the nip and the water jets, for instance, can be monitored, as these cause most of the deviations occurring in the felt profile. Vacuum measurements can be employed to register the structure of a new felt and its properties at the start-up stage and then follow its compression or clogging during operation. Also, vacuum measurements can be used to follow the filling and clogging of the felt, and the geometry of the nip and the structure of the felt during operation over a longer period of time. Microwave measurements can be used to determine e.g. the amount of water contained in the felt, that is, the operation of the felt, the operation of the water jets and the geometry of the nip can be followed on the basis of variation in the amount of water. The different ways of measurement provide information about different properties at different stages and variation in the properties as well as information about the resulting changes in felt conditions, so that problems can be anticipated at an early stage by simultaneously observing curves based on measuring results obtained by the different measuring techniques. Even though the curves obtained by the different measuring techniques are partly independent of each other, all measuring results are affected at least to some extent by the same factors over a certain period of time. The vacuum measurement may respond to a specific factor at a later stage than the microwave measurement, or vice versa, and at this stage the problem may already be severe. Therefore it is necessary to use the different ways of measuring concurrently to detect a possible problem as early as possible.

FIGS. 3*a* to 3*c* show schematically a few problem situations typically occurring in the operation of the press section of a paper machine. The figures show how such problem situations appear in measuring curves obtained by the apparatus according to the invention. FIG. 3*a* shows a curve illustrating the contamination or clogging of a felt at a certain point. Over a short period of time, this does not appear in any way in the other measurements, but the vacuum measurement, i.e. the air permeability measurement, indicates the contamination substantially immediately, and so the reconditioning by needle jets can be directed to the clogged portion.

FIG. 3*b* shows a situation where there occurs a deviation in the press temperature for one reason or another, which usually indicates that there is a deviation in the press profile or in the felt profile. On the contrary, the vacuum measuring curve and the measuring curve representing the water amount are usually as straight as such felt property curves can be. In this case, the vacuum measurement and the water amount measurement carried out by microwaves do not respond to the situation, and so the temperature measurement is of vital importance here.

FIG. 3*c* shows a situation where the press effect of the press is not uniform, and so the amount of water in the felt varies, which results in uneven water removal from the web and uneven web quality. As appears from FIG. 3c, the curves indicating temperature and air amount i.e. vacuum are now relatively straight. As a result, the nip of the press section can be adjusted until the situation is again normal. If this situation is allowed to continue, the felt will be compressed unevenly in the long run, which will finally affect the air permeability of the felt, but at this stage the felt would already have been damaged permanently.

FIG. 4 in turn shows schematically the position of the apparatus according to the invention in a paper machine (the paper machine refers to a paper machine, cardboard machine and other similar machines producing a weblike product from a fibre suspension). As appears from FIG. 4, the felt 2 rotates about rolls 10a to 10g in the press section, thus forming a closed loop. The roll 10e and a larger press roll 11 form a nip through which the web passes between the press felt 2 and the roll 11 so that water is squeezed out of the web into the felt 2. Thereafter the felt passes in the direction indicated by the arrow A over the roll 10f to a measuring point where the measuring head 1 is pressed against the felt 2 during measurement. Measuring lines, at the simplest measuring lines 12, 13 and 14 of separate sensors, connect the measuring head to a measuring unit. The measuring line 12 connects the microwave head to the measuring and analysing unit 15; the measuring line connects the vacuum sensor measuring air permeability to the measuring unit 15; and the measuring line 14 connects the temperature sensor to the measuring unit 15. The measuring unit displays the measuring results on a screen 15a. The reference numeral 16 indicates a measuring beam extending across the felt. The measuring head moves along the measuring beam on wheels attached to the arm of the measuring head. FIG. 4 further shows a needle jet head 17 for providing reconditioning jets. Needlelike water jets can be applied to the felt 2 through the needle jet head to recondition the felt on the basis of the measuring data. After the measuring point the felt further passes over a roll 10g and then passes by a suction box 18 which is connected to the same vacuum source as the measuring head through a conduit 19. In the measuring apparatus according to FIG. 4, the measuring unit 15 is a computer which receives the measuring data obtained by means of the different sensors and displays the data in a predetermined way, i.e. in the form of a measuring profile, typically a transverse felt profile shown in FIGS. 3a to 3c. By measuring the air permeability, water retention capacity and water amount of a new felt immediately after the installation of the felt, reference values are obtained for subsequent felt measuring data. In this way, it is easy to notice if the measuring curve deviates at one particular point from the original measuring curve more than at any other point, and so this particular point can be paid attention to. Similarly, the felt can thus be reconditioned by the needle jets only at points where reconditioning is required according to the measuring data, thus avoiding unnecessary treatment. As only areas clearly in the need of reconditioning are treated, the felt properties and the web quality are maintained more uniform as compared with the cleaning and washing of the felt by needle jets over the entire width of the felt.

The invention has been described and shown in the above description and drawings only by way of example, and it is in no way restricted to them. The structure of the measuring apparatus may be realized in many different ways, and its electric connection arrangement and other connections may vary. Different type of devices for creating vacuum and for realizing the measuring of the condition, i.e. air permeability of the felt are possible within the scope of the claims. The different ways of measuring and different combinations of the measuring and reconditioning measures can be realized in accordance with the invention, and the apparatus according to the invention can, of course, be used merely for measuring the condition of the felt and registering the initial air permeability of the felt, or merely for reconditioning the felt over its entire width without any measuring.

I claim:

1. Apparatus for measuring the condition of a felt in a paper machine, comprising a measuring head arranged to be positioned against the surface of the felt, an air conduit being connected to the measuring head for sucking air through the felt into the measuring head by utilizing a vacuum, and a water removal conduit being connected to said measuring head for separately removing water carried with the air into the measuring head from the felt; measuring means for measuring the vacuum created during measuring; a microwave radiator connected to the measuring head for measuring the water content of the felt, and a temperature detector for measuring the temperature of the air sucked through the measuring head into the air conduit.

2. Measuring apparatus according to claim 1, wherein the microwave radiator is arranged to measure the water content of the felt concurrently with the vacuum measurement.

3. Measuring apparatus according to claim 1, wherein the temperature detector is arranged to measure the air temperature continuously during the vacuum measurement.

4. Measuring apparatus according to claim 1, further comprising a display device for simultaneously displaying the measured value of each concurrent measurement in the form of a transverse profile of the felt.

5. Measuring apparatus according to claim 4, further comprising data preparation means for receiving said measured values and preparing said measured values for display by said display device in a predetermined format.

6. Measuring apparatus according to claim 5, wherein said data preparation means is a computer.

7. Measuring apparatus according to claim 1, wherein said temperature detector is a thermometer.

8. Measuring apparatus according to claim 1, wherein said microwave radiator is adapted for measuring the thickness of the felt.

9. Measuring apparatus according to claim 1, wherein said microwave radiator emits radiation at a frequency within a range of several to several thousand megahertz.

10. Measuring apparatus according to claim 1, wherein said measuring head includes a perforated sensor surface to facilitate said sucking of air through the felt and into the measuring head.

11. Measuring apparatus according to claim 10, wherein said measuring head further includes a separation plate mounted therein for separating water carried with the air into the measuring head.

12. Measuring apparatus according to claim 1, further comprising support means for adjustably supporting said measuring head.

13. Measuring apparatus according to claim 12, wherein said support means is adapted to facilitate the movement of said measuring head to one or more selected positions along a width of the felt.

14. Measuring apparatus according to claim 13, further comprising means for reconditioning said felt in accordance with said measurements.

15. Measuring apparatus according to claim 14, wherein said means for reconditioning is mounted to said support means.

16. Measuring apparatus according to claim 15, wherein said means for reconditioning is a needle jet head.

* * * * *